US006810774B2

(12) United States Patent
Hsien

(10) Patent No.: US 6,810,774 B2
(45) Date of Patent: Nov. 2, 2004

(54) WRENCH TOOL HAVING MAGNET CONNECTED THERETO

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/298,531

(22) Filed: Nov. 19, 2002

(65) Prior Publication Data

US 2004/0093998 A1 May 20, 2004

(51) Int. Cl.[7] ..... B25B 13/02
(52) U.S. Cl. ..... 81/125; 81/119; 81/900
(58) Field of Search ..... 81/125, 900, 119, 81/121.1

(56) References Cited

U.S. PATENT DOCUMENTS

| | | | | | |
|---|---|---|---|---|---|
| 3,447,405 | A | * | 6/1969 | Lennon et al. | 81/119 |
| 4,078,709 | A | * | 3/1978 | Jenkins | 226/180 |
| 4,314,593 | A | * | 2/1982 | Schwartz | 81/22 |
| 4,823,652 | A | * | 4/1989 | Morrissey et al. | 81/125 |
| 5,331,869 | A | * | 7/1994 | Webb | 81/177.1 |
| 5,924,343 | A | * | 7/1999 | Bogni et al. | 81/125 |

* cited by examiner

*Primary Examiner*—Debra S. Meislin

(57) ABSTRACT

A wrench includes two jaws extending from an end of a handle and a hole is defined in one of the jaws. The hole communicates with a clamping surface of the jaw having the hole and a magnet is received in the hole. The magnet attracts the object that is clamped by the wrench while in use.

1 Claim, 4 Drawing Sheets

WRENCH TOOL HAVING MAGNET CONNECTED THERETO

FIELD OF THE INVENTION

The present invention relates to a wrench that has at least one magnet embedded in one of the two jaws so as to attract an object during use.

BACKGROUND OF THE INVENTION

A conventional wrench generally includes two jaws and a handle. An object can be clamped between the two jaws and is rotated to be loosened or tightened. The opening of the two jaws is slightly larger than the object to be loosened or tightened so that it is easily to mount the jaws to the object. In order to clamp the object, the user has to carefully operate the wrench to make sure that the object is located in the opening. This is difficult to maintain the object in the opening especially when the object is loosened. Besides, the object to be loosened could be hot in temperature or contaminated by toxic material so that the user cannot touch. In this situation, the conventional wrench is more difficult to maintain the object in the opening.

The present invention intends to provide a wrench that has a magnet embedded in one of the two jaws so as to keep the object in the opening between the two jaws.

SUMMARY OF THE INVENTION

In accordance with one aspect of the present invention, there is provided a wrench which comprises two jaws on one end of a handle of the wrench and a hole is defined in one of the jaws. The hole communicates with a clamping surface of the jaw having the hole and a magnet is received in the hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
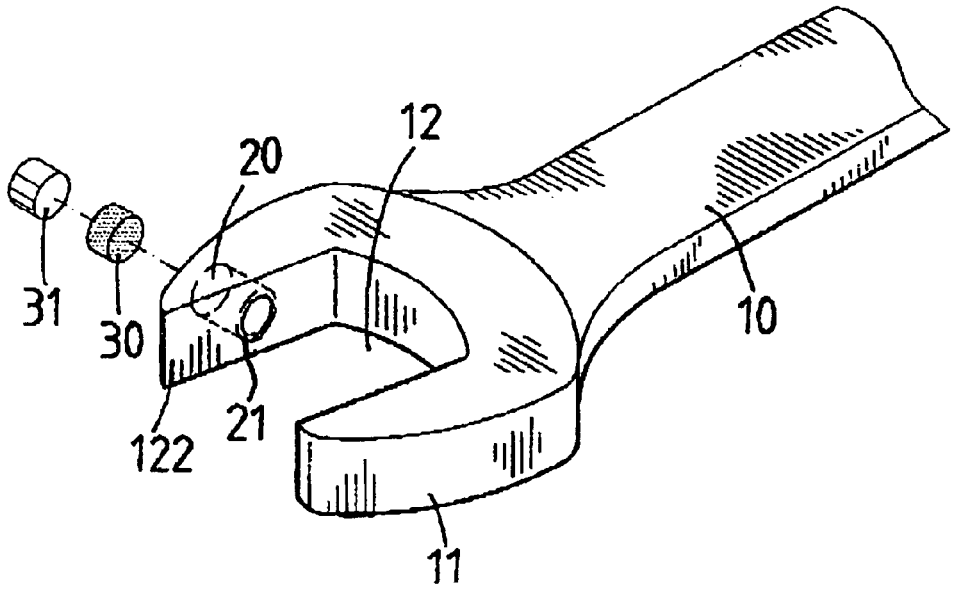
FIG. 1 is an exploded view to show a magnet and the wrench of the present invention.
Figure 2:
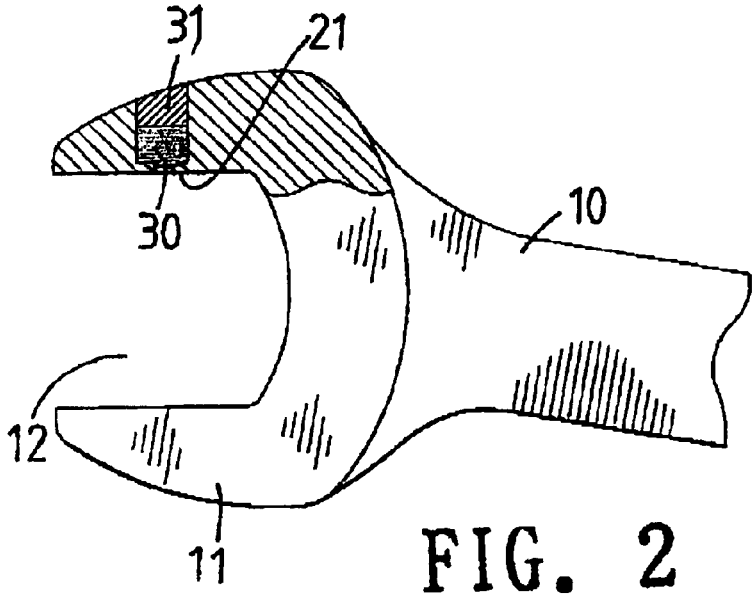
FIG. 2 is a cross sectional view to show the wrench of the present invention.
Figure 3:
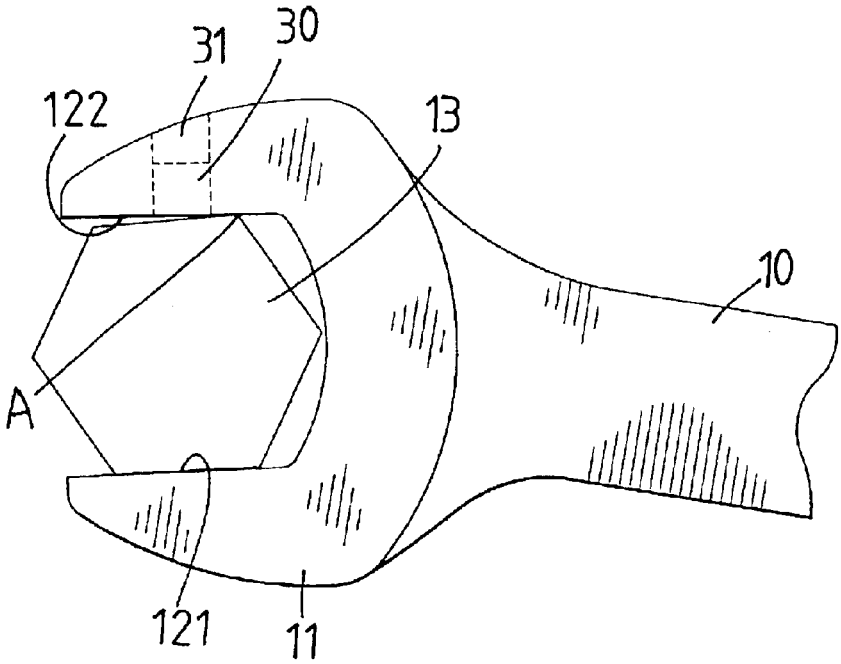
FIG. 3 shows that an object is clamped by the two jaws of the present invention.
Figure 4:
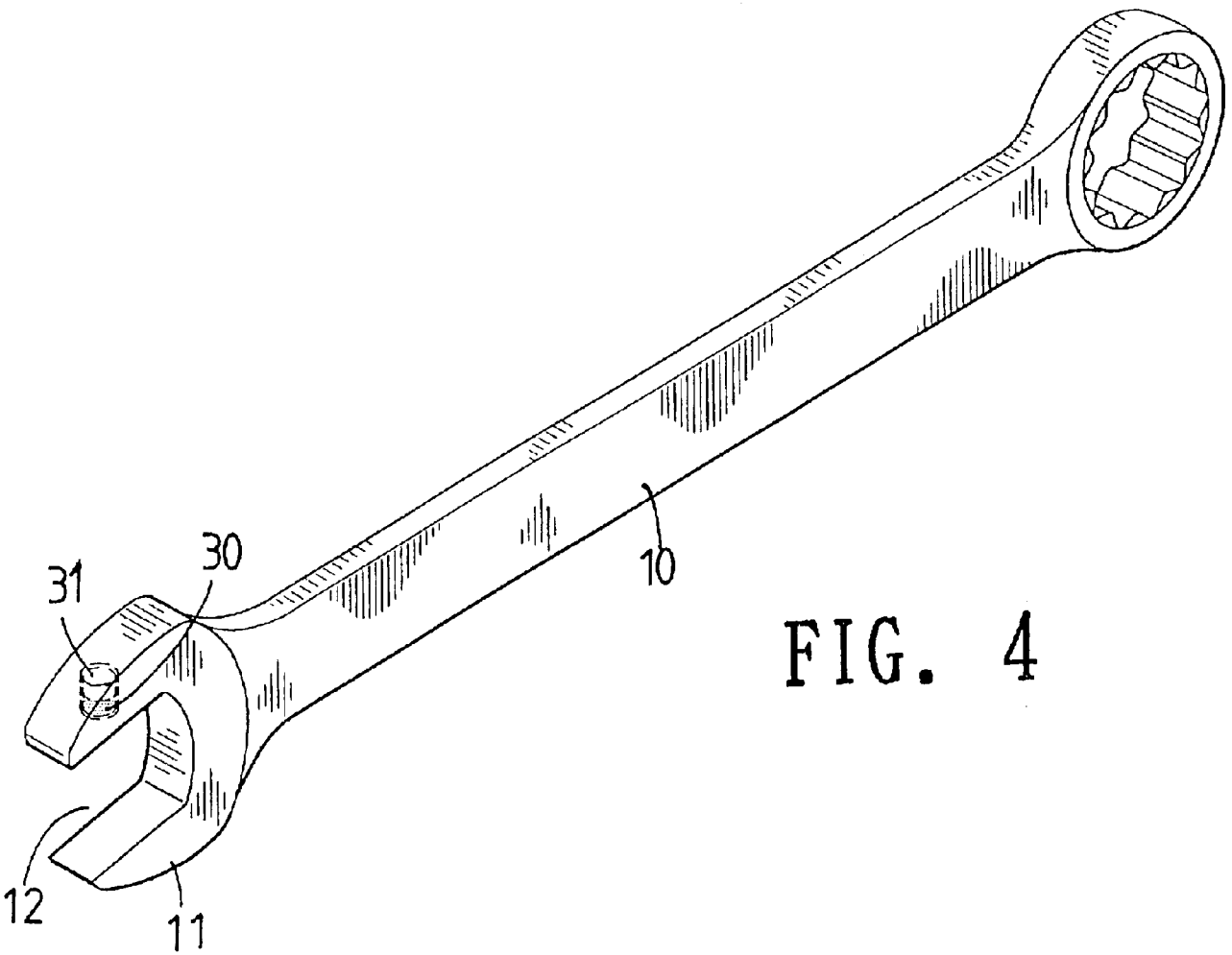
FIG. 4 is a perspective view to show the wrench of the present invention.

Referring to FIGS. 1 to 4, the wrench of the present invention comprises two jaws 11 extending from an end of a handle 10 of the wrench and a hole 20 is defined in one of the jaws 11. The hole 20 communicates with a clamping surface 122 of the jaw 11 having the hole 20 and the hole 20 defines an opening which communicates with the clamping surface 122. A flange 21 extends inward from the opening.

A magnet 30 is received in the hole 20 and stopped by the flange 21 so that the magnet 30 is retained in the hole 20. An end piece 31 is received in the hole 20 and located in opposite to the clamping surface of the jaw 11. The end piece 31 is in flush with an outer surface of the jaw 11 and is polished such that the outer surface of the jaw 11 is smooth. An object such as a nut 13 is received in the space 12 between the two jaws 11 and can be attracted by the magnet 13.

Because the nut 13 generally applies a force at point "A" on the clamping surface 122 and the clamping surface 121 on the other jaw 11 so that the hole 20 is drilled away from the point "A" may reduce the possibility of weakening the structural strength of the jaw 11.

Figure 6:
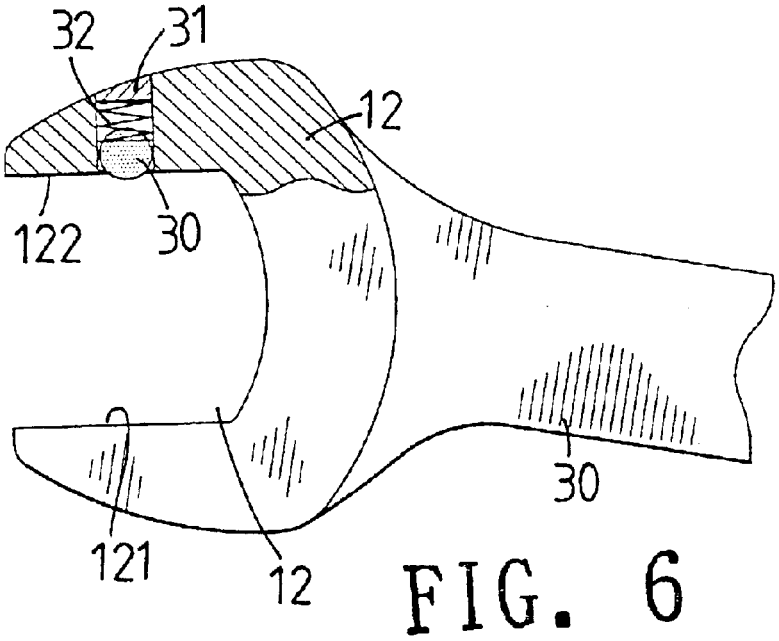
FIG. 6 shows a spring biased between the magnet and an end piece.
Figure 5:
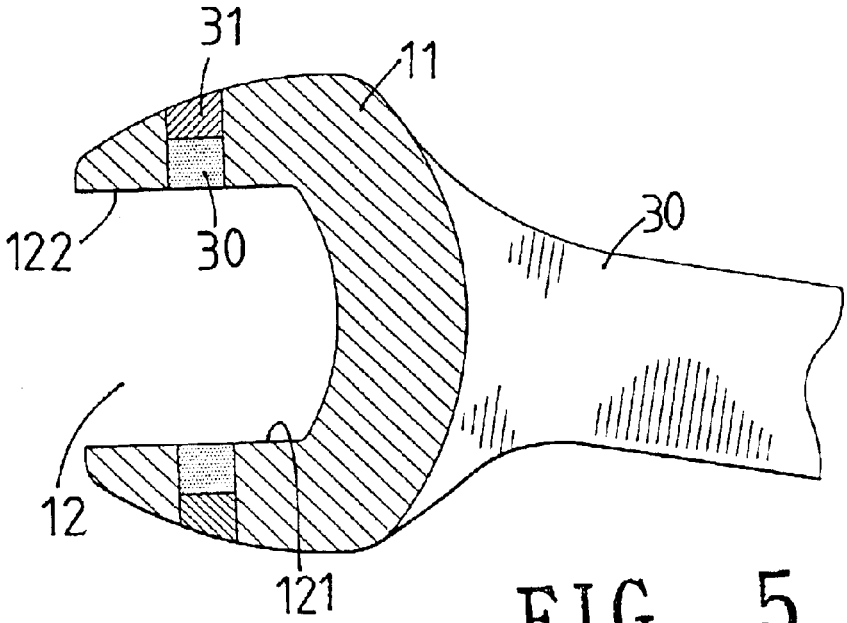
FIG. 5 is a cross sectional view to show that both of the two jaws have a magnet.

FIG. 5 shows that both of the two jaws 11 have a magnet 30 received therein so as to position the nut 13 firmly. FIG. 6 shows a spring 32 is biased between the magnet 30 and the end piece 31. The magnet 30 is allowed to be slightly protruded into the space 12 between the two jaws 11 so that the object to be clamped contacts the magnet 30 for sure.

While we have shown and described the embodiment in accordance with the present invention, it should be clear to those skilled in the art that further embodiments may be made without departing from the scope of the present invention.

What is claimed is:

1. A wrench comprising:

two jaws extending from an end of a handle of the wrench and a hole defined in one of the jaws, the hole defining an opening which communicates with a clamping surface of the jaw having the hole, a flange extending inward from the opening, and a magnet being completely retained in the hole by the flange, an end piece received in the hole and located in opposite to the clamping surface of the jaw.

* * * * *